United States Patent [19]

Höfert

[11] 4,320,481

[45] Mar. 16, 1982

[54] SETTING DEVICE FOR ANALOG-DISPLAY MOTOR VEHICLE CLOCKS

[75] Inventor: Paul Höfert, Frankfurt am Main, Fed. Rep. of Germany

[73] Assignee: VDO Adolf Schindling AG, Frankfurt am Main, Fed. Rep. of Germany

[21] Appl. No.: 112,374

[22] Filed: Jan. 15, 1980

[30] Foreign Application Priority Data

Jan. 17, 1979 [DE] Fed. Rep. of Germany ..... 2901634

[51] Int. Cl.[3] ..... G04B 27/02; G04B 29/00

[52] U.S. Cl. ..... 368/190; 368/319

[58] Field of Search ..... 368/10, 69, 76, 80, 368/88, 184–188, 190–195, 206, 216, 319; 200/5 A, 28, 156–159 R

[56] References Cited

U.S. PATENT DOCUMENTS

| | | | |
|---|---|---|---|
| 3,204,067 | 8/1965 | Brown | 200/156 |
| 3,492,807 | 2/1970 | Kohlhagen | 368/185 |
| 3,641,286 | 2/1972 | Berezowski | 200/159 R |
| 3,928,741 | 12/1975 | Comer | 200/159 R |
| 4,063,054 | 12/1977 | Hirata | 200/159 R |
| 4,072,004 | 2/1978 | Tanaka et al. | 368/10 |
| 4,201,043 | 5/1978 | Tarusawa | 368/10 |

*Primary Examiner*—Vit W. Miska

*Attorney, Agent, or Firm*—Martin A. Farber

[57] ABSTRACT

A setting device for analog-display motor vehicle clocks having an operating knob made of injection-molded plastic, which knob is turnable and elastically displaceable axially within a central passage opening in the cover glass against the action of a spring, the knob being provided with a driver for engagement into the pointer shaft. The driver, and at least two guide pins which are provided with grappling hooks, are formed of plastic integrally in one-piece with the operating knob. The guide pins are dimensioned in such a manner with respect to their material and length that the operating knob is inserted from the front side of the cover glass through the passage opening with deflection of the hooks with the guide pins and is secured against falling out after the hooks engage through and return into their original unstressed position.

10 Claims, 2 Drawing Figures

SETTING DEVICE FOR ANALOG-DISPLAY MOTOR VEHICLE CLOCKS

This invention relates to a setting or adjustment device for analog-display motor vehicle clocks having an operating knob made of injection-molded plastic, which knob is turnable and elastically displaceable axially within a central passage opening in the cover glass against the action of a spring, the knob being provided with a driving means for engagement into the pointer or setting-hands shaft.

Such a setting device is known from German Pat. No. 24 18 731 which describes a central hand-setting device in a clock for motor vehicles, which central hands-setting device consists of a sleeve which can be connected within the central hands-setting device to a setting shaft, which setting shaft is guided centrally in the clock glass, is turnable and can be displaced axially against the force of a spring.

One disadvantage of this known setting device is the expensive method of manufacture for the mounting of a large number of individual parts which in addition also have the disadvantage that the setting knob extends relatively far out on both sides of the cover glass in order for its mounting to be able to be effected in a somewhat practical manner. In this way the cover glass of clocks is prevented from being mounted as close as possible (as it in itself is desired) over, i.e. spaced from the hands.

The object of the invention is therefore to create a setting device which can be manufactured inexpensively, and mounted simply and rapidly and without tools, and of particularly flat formation so that the cover glass can be arranged as close as possible over the hands of a motor vehicle clock.

This object is aided in its solution in a setting device of the afore-mentioned type in the manner that the driving means (3) and at least two guide pins (5) which are provided with grappling hooks are formed integrally in one-piece with the operating knob (1) made of plastic and the guide pins (5) are dimensioned in such a manner with respect to their material and length that the operating knob (1) is inserted from the front side of the cover glass (2) through the passage opening (7) therein with deflection of the hooks (6) with the guide pins (5) and is secured against falling out after the passing or engaging through of the hooks and their return into their original unstressed position, the guide pins have circular segment shaped cross-sections guidably engaging the cylindrical passage opening.

The guide pins of the operating knob therefore have two purposes, namely on the one hand to assure a simple mounting by the clip-like engagement, for which hooks are required, and on the other hand to provide the guidance in the cover glass, for which the hooks are of no importance since in the pushed-in position they are disposed free behind the cover glass. For this purpose of guidance the guide pins advantageously have their cross section in the form of circular segments adjusted or complementary to the passage opening. In order to increase the guidance surface of the cover glass, the latter is formed in the manner that in the region of the passage opening it projects cylindrically in the direction opposite to the actuation direction. The edge formed by the cylindrical projection on the cover glass furthermore retains the reset or restoring spring of the operating knob. The guide pins are formed in the shape of segments so as to be adjusted complementarily to the passage opening. Depending on the size of the operating knob, a plurality of guide pins could, of course, also be used.

Another advantage of the invention is that a channel or groove into which the hooks engage is formed in the cover glass on the side thereof which faces away from the actuation side. In the pulled out or extended position of the operating knob, the knob projects in this way minimally beyond the cover glass, which cover glass as a result can be mounted particularly close above the hands of the automobile clock. Another advantage of the invention is that a collar (10) is formed on the cover glass (2) around the passage opening (7), which collar has a diameter which is greater than a head (9) of the operating knob (1), as a result of which the operating knob appears sunken when in its non-depressed position. In order nevertheless to be able to move it easily, radially directed flutings or ridgings are advantageously provided on the front side of the knob.

Finally, it has also been found that the operating knob can be produced to particular advantage from a polyacetal, particularly polyoxymethylene material.

With the above and other objects and advantages in view, the present invention will become more clearly understood in connection with the detailed description of a preferred embodiment, when considered with the accompanying drawings, of which:

Figure 1:
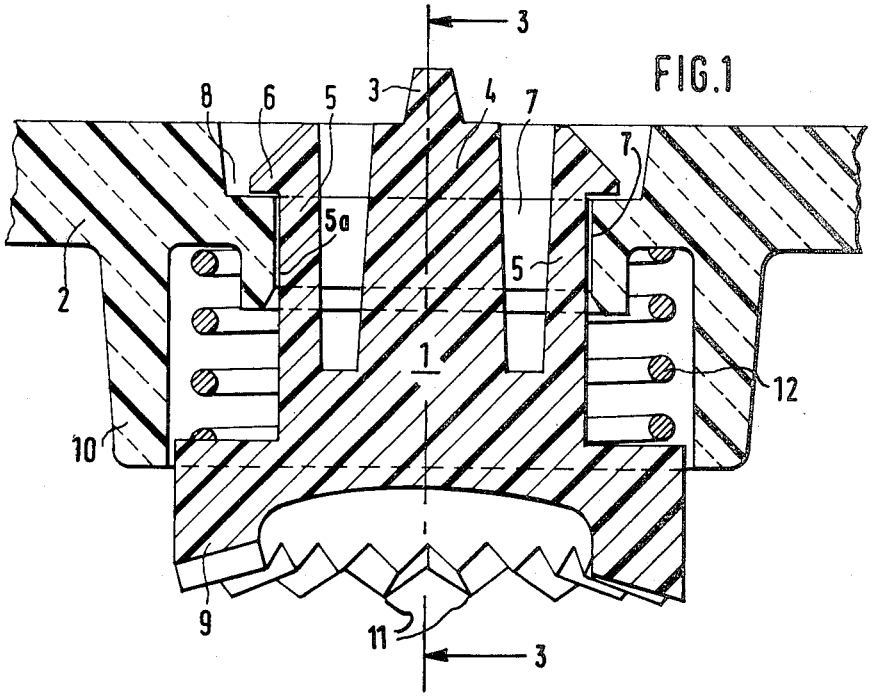
FIG. 1 shows in cross section the operating knob in that section of the cover glass of the automobile clock which is of importance for the invention.

In FIG. 1 there is shown on an enlarged scale the central portion of a cover glass 2, which central portion is important for the invention as will be discussed.

The cover glass 2 is arranged in front of an automobile clock (not shown), which is to be imagined as lying above the drawing and extending towards both sides by the same distance as the cover glass 2, only a portion of which is shown.

The operating knob 1 produced by injection molding is made of one piece of polyoxymethylene (bearing the tradename Hostaform) integral in one-piece with a driving means 3 arranged on a base 4 and has guide pins 5 with barbed or grappling hooks 6. The one-piece part 1 is mounted in a simple manner in the cover glass 2 by pushing it through a correspondingly matching cylindrical passageway opening 7 in the cover glass, the guide pins 5 bearing the hooks or barbs 6 thereby being deflected or bending inwardly. Already before the complete compression of a coil spring 12, which is installed at the same time against the head 9 of the operating knob and the cover glass between a projecting abutment or cylindrical shoulder and a collar 10 of the cover glass, and before the head 9 of the operating knob comes against the cylindrical shoulder or projecting abutment of the passage opening 7, the hooks 6 snap into the groove or channel 8 in the cover glass 2. The guide pins 5 are detensioned and relaxed again returning into their normal position with the circular arcshaped outer peripheral surfaces 5*a* of the pins 5 guidably engaging against the circular cylindrical passage opening 7 and the driving means 3 which is arranged on the base 4 comes into engagement with the pointer- or hands-setting shaft of the clock (not shown) by the operating knob being pushed-in further against the elastic restoring force of the spring 12. In order to facilitate turning of the operating knob, a grooving or ridging 11 is provided on the front or face of the operating knob, so that the knob can also be referred to as a "thumb turning knob."

Since as a result of the formation of the groove 8, the guide surface in the cylindrical passage opening 7 is decreased, and since furthermore the fixed stop or projecting abutment is provided for the completely compressed coil spring 12, the edge of the passage opening 7 is preferably extended outwardly by the projecting abutment in the direction opposite that of actuation in order to prevent damage to the hands-setting shaft (not shown) as a result of an excessively forceful depression of the operating knob. Around this edge and at a distance spaced from it the cover glass 2 is provided with the collar 10 into which the widened head 9 of the operating knob 1 can be introduced and fully depressed. A further guide surface for the knob 9 is present on the inner peripheral side of the collar 10 which supplements the guiding of the operating knob in the passage opening 7.

Figure 2:
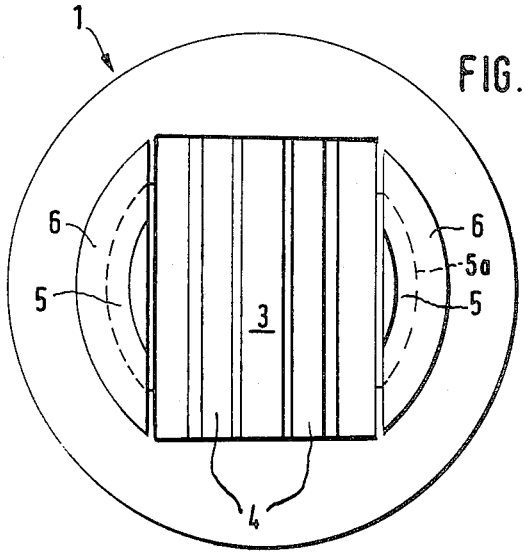
FIG. 2 is a view of the operating knob from that side which is opposite to the actuating side.
Figure 3:
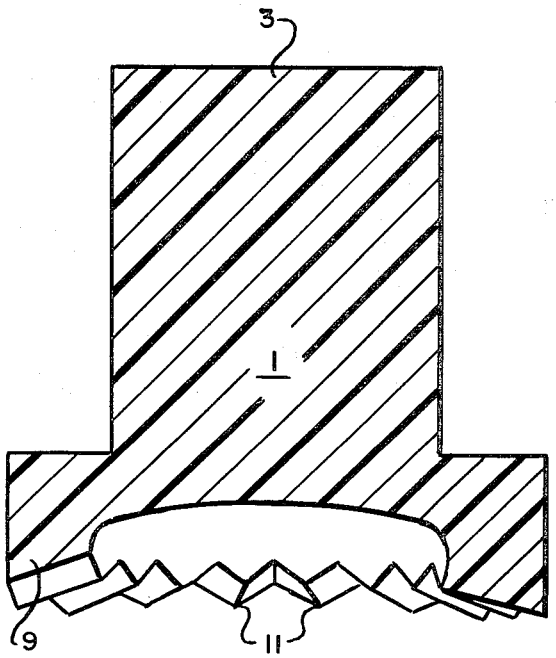
FIG. 3 is a section taken along the lines 3—3 of FIG. 1.

From the rear view of the operating knob, shown without the cover glass 2 and without the spring 12 in FIG. 2, in which the corresponding parts have the same reference numbers as in FIG. 1, it can be seen that the guide pins 5 are formed in the shape of circular segments. Despite release (i.e., non-engagement) of the barbed or grapple hooks 6 in the pressed condition of the operating knob 1, the knob is guided axially and rotatably on two circular segment parts (namely arcuate surfaces 5*a* of the pins 5) against the passage opening 7 of the guidance cylinder.

A similar guidance could be obtained by arranging a plurality of small guide pins on the segment of the illustrated guide pin. Such a development, to be sure, is practicable only if the operating knob is of sufficient size.

An operating knob of the type described can, of course, also be mounted in a cover glass with a corresponding passage opening, which cover glass is not intended solely as a cover for an automobile clock. It is furthermore conceivable and practical to provide the groove, cylindrical guidance and collar in an existing cover plate of automobile instruments so as to permit the subsequent insertion of such an operating knob, which has the same advantages, namely simple and cheap manufacture and rapid mounting.

While there have been disclosed embodiments of the invention, it is to be understood that these embodiments are given by example only and not in a limiting sense.

I claim:

1. In a setting device for analog-display motor vehicle clocks having an operating knob made of injection-molded synthetic material, which knob is rotatably mounted and elastically displaceable axially within a central passage opening in a cover glass from a front side against the action of a spring, the knob being provided with a driving means for engagement into a pointer shaft, the improvement wherein the operating knob includes the driving means and at least two pins, said pins have grappling hooks, said operating knob including said driving means and said pins are formed integrally in one-piece and made of synthetic material, said passage opening in the cover glass is cylindrical, the pins have a cross-section in the form of circular segments complementary to the passage opening constituting guiding surface means for guiding said operating knob in said passage opening in an operating condition axially and rotatably, said pins being resilient and dimensioned in such a manner with respect to said synthetic material and their length that the operating knob is inserted from a front side of the cover glass through the passage opening therein with deflection of said hooks with said pins and is secured against falling out after engaging of the hooks in the cover glass and setting of the hooks and the pins into an original unstressed position.

2. The setting device as set forth in claims 1, wherein the cover glass has an inwardly stepped rear side forming a channel having a larger diameter than that of the passage opening and communicating therewith, said rear side is on the other side of the cover glass opposite from the front side, the latter constituting an actuation side of the operating knob, said hooks face radially outwardly and engage on said inwardly stepped rear side in said channel in a mounted condition of said operating knob.

3. The device as set forth in claim 2, wherein said operating knob has a head which is greater in diameter than the diameter of the cylindrical passage opening, a collar surrounding said head is formed on the front side of the cover glass around the passage opening, said collar has a diameter which is greater than that of said head of said operating knob.

4. The device as set forth in claim 1, wherein said operating knob has a front end side formed with radially directed ridgings.

5. The device as set forth in claim 1, wherein said operating knob is made of a polyacetal material.

6. The device as set forth in claim 5, wherein said polyacetal material is a polyoxymethylene material.

7. The device as set forth in claim 3, wherein said diameter of said collar is slightly larger than that of said head of said operating knob.

8. The device as set forth in claim 3, wherein a projecting abutment is formed on the front side of the cover glass having an inner surface constituting a continuation of said passage opening, said projecting abutment is shorter than said collar and spaced inwardly therefrom.

9. The device as set forth in claim 1, wherein said passage opening is circular in cross-section and said pins have an outer peripheral surface of circular arc shape constituting said guiding surface means engaging said passage opening in the operating condition.

10. The device as set forth in claim 3, wherein the diameter of said channel is larger than a radially outermost portion of said hooks such that said hooks are radially unabutted and said pins are in said original unstressed position in said mounted and operating conditions in said channel.

* * * * *